US010918913B2

(12) United States Patent
Dillon et al.

(10) Patent No.: US 10,918,913 B2
(45) Date of Patent: Feb. 16, 2021

(54) TENNIS BALL

(71) Applicant: Wilson Sporting Goods Co., Chicago, IL (US)

(72) Inventors: William E. Dillon, Chicago, IL (US); Frank M. Simonutti, Wheaton, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 16/114,639

(22) Filed: Aug. 28, 2018

(65) Prior Publication Data

US 2020/0070010 A1 Mar. 5, 2020

(51) Int. Cl.

| | |
|---|---|
| ***A63B 39/02*** | (2006.01) |
| ***A63B 39/06*** | (2006.01) |
| *A63B 102/02* | (2015.01) |
| *A63B 39/00* | (2006.01) |

(52) U.S. Cl.

CPC ..... *A63B 39/02* (2013.01); *A63B 39/06* (2013.01); *A63B 2039/006* (2013.01); *A63B 2102/02* (2015.10); *A63B 2209/00* (2013.01)

(58) Field of Classification Search

CPC ... A63B 39/02; A63B 39/06; A63B 2039/006; A63B 2102/02; A63B 2209/00; A63B 2039/003

See application file for complete search history.

(56) References Cited

U.S. PATENT DOCUMENTS

| | | | | |
|---|---|---|---|---|
| 1,376,778 A | | 5/1921 | Orr | |
| 2,131,756 A | * | 10/1938 | Roberts | A63B 39/00 473/605 |
| 2,210,954 A | | 8/1940 | Roberts | |
| 3,065,520 A | | 11/1962 | Schmidt | |
| 3,396,970 A | | 8/1968 | Fraser, Jr. et al. | |
| 3,442,101 A | | 5/1969 | Ploch et al. | |
| 3,684,284 A | | 8/1972 | Tranfield | |
| 3,904,201 A | | 9/1975 | Henry | |
| 4,022,469 A | * | 5/1977 | Lacoste | A63B 39/06 473/606 |
| RE29,303 E | | 7/1977 | Fraser, Jr. et al. | |
| 4,098,504 A | | 6/1978 | Koziol et al. | |
| 4,124,117 A | | 11/1978 | Rudy | |
| 4,145,045 A | * | 3/1979 | Pocklington | A63B 39/00 260/998.14 |

(Continued)

FOREIGN PATENT DOCUMENTS

| | | | | |
|---|---|---|---|---|
| AU | 2008328999 A1 | * | 6/2009 | A63B 37/00 |
| DE | 128085 A | * | 11/1977 | |

(Continued)

OTHER PUBLICATIONS

Shore Durometer Conversion Chart, <http://polymerdatabase.com/polymer%20physics/Shore%20Table.html>, retrieved on Jun. 19 , 2019, dated 2015. (Year: 2015).*

(Continued)

*Primary Examiner* — Steven B Wong

(74) *Attorney, Agent, or Firm* — Terrance P. O'Brien; Todd A. Rathe

(57) ABSTRACT

A tennis ball may include a spherical hollow elastomeric core having a specific gravity of less than 1 and a thickness of at least 4.5 mm and a textile layer covering the spherical hollow core.

16 Claims, 3 Drawing Sheets

(56) References Cited

U.S. PATENT DOCUMENTS

| | | | | | |
|---|---|---|---|---|---|
| 4,249,730 | A * | 2/1981 | Frisk | A63B 39/00 | 273/DIG. 20 |
| 4,300,767 | A * | 11/1981 | Reed | A63B 39/00 | 473/594 |
| 4,305,583 | A * | 12/1981 | Tandon | A63B 39/00 | 473/609 |
| 4,306,719 | A * | 12/1981 | Haines | A63B 39/00 | 260/998.14 |
| 4,318,875 | A | 3/1982 | Shrimpton et al. | | |
| 4,340,222 | A | 7/1982 | Kerkenbush et al. | | |
| 4,439,471 | A * | 3/1984 | Lacoste | A63B 39/06 | 428/36.1 |
| 4,580,781 | A * | 4/1986 | Horiuchi | A63B 39/00 | 260/998.14 |
| 4,616,828 | A | 10/1986 | Haythornthwaite | | |
| 4,739,989 | A * | 4/1988 | Prinz | A63B 39/00 | 273/DIG. 20 |
| 4,853,056 | A | 8/1989 | Hoffman | | |
| 4,853,057 | A | 8/1989 | Hoffman | | |
| 4,946,166 | A | 8/1990 | Horiuchi et al. | | |
| 4,947,466 | A | 8/1990 | Horiuchi et al. | | |
| 5,209,471 | A * | 5/1993 | Horiuchi | A63B 39/00 | 260/998.14 |
| 5,211,788 | A | 5/1993 | Song | | |
| 5,225,258 | A * | 7/1993 | Nakamura | A63B 39/00 | 428/36.8 |
| 5,308,060 | A * | 5/1994 | Nakamura | A63B 39/06 | 442/324 |
| 5,413,333 | A | 5/1995 | Janes et al. | | |
| 5,460,367 | A * | 10/1995 | Horiuchi | A63B 39/00 | 260/998.14 |
| 5,551,688 | A | 9/1996 | Miller | | |
| 5,558,325 | A * | 9/1996 | Hargis | A63B 39/00 | 273/DIG. 4 |
| 5,593,157 | A | 1/1997 | Koros et al. | | |
| 5,830,092 | A | 11/1998 | Meeks | | |
| 5,848,690 | A | 12/1998 | Granger et al. | | |
| 6,030,304 | A * | 2/2000 | Simonutti | A63B 39/00 | 473/604 |
| 6,106,419 | A | 8/2000 | Hall et al. | | |
| 6,227,992 | B1 | 5/2001 | Brasier | | |
| 6,508,732 | B1 | 1/2003 | Romberger et al. | | |
| 6,677,257 | B2 | 1/2004 | Brasier | | |
| 7,611,429 | B2 | 11/2009 | O'Neill et al. | | |
| 7,985,779 | B2 | 7/2011 | Vleghert | | |
| 3,029,394 | A1 | 10/2011 | Burke | | |
| D668,947 | S | 10/2012 | Niksich | | |
| 8,771,375 | B2 | 7/2014 | Rodengen et al. | | |
| 9,675,847 | B2 | 6/2017 | Jahnigen et al. | | |
| 2005/0026521 | A1 | 2/2005 | Brasier | | |
| 2007/0100089 | A1 | 5/2007 | Nesbitt et al. | | |
| 2009/0023525 | A1* | 1/2009 | Vleghert | A63B 39/00 | 473/606 |
| 2009/0318251 | A1 | 12/2009 | Limerkens et al. | | |
| 2010/0261563 | A1* | 10/2010 | Verbeke | A63B 37/00 | 473/607 |
| 2010/0307637 | A1 | 12/2010 | Dirst | | |
| 2012/0165143 | A1 | 6/2012 | Kanda et al. | | |
| 2012/0298050 | A1 | 11/2012 | Merritt | | |
| 2013/0017912 | A1 | 1/2013 | DeAngelis-Duffy | | |
| 2018/0264326 | A1 | 9/2018 | Simonutti et al. | | |
| 2018/0264327 | A1 | 9/2018 | Simonutti et al. | | |
| 2019/0127560 | A1* | 5/2019 | Hyodo | A63B 39/027 | |

FOREIGN PATENT DOCUMENTS

| | | | | |
|---|---|---|---|---|
| EP | 0022961 | | 1/1981 | |
| EP | 0456036 | | 11/1991 | |
| EP | 0459436 | | 12/1991 | |
| FR | 2638375 | | 5/1990 | |
| GB | 719467 | | 12/1954 | |
| GB | 1108555 | A * | 4/1968 | B29D 22/04 |
| GB | 2038643 | | 7/1980 | |
| JP | 61228040 | A * | 10/1986 | |
| WO | WO-2009068421 | A1 * | 6/2009 | A63B 37/00 |
| WO | 2015056193 | | 4/2015 | |

OTHER PUBLICATIONS

"Pressurized vs. Non-Pressurized Tennis Balls", <https://livehealthy.chron.com/pressurized-vs-nonpressurized-tennis-balls-6747.html>, retrieved on Jun. 19, 2019, pp. 1-4. (Year: 2019).*

The Engineering Tool Box "Density, Specific Weight and Specific Gravity", retrieved on Dec. 6, 2019, <https://www.engineeringtoolbox.com/density-specific-weight-gravity-d_290.html>. (Year: 2019).*

MatWeb:Material Property Data "ExxonMobil EXACT 4033 Plastomer for Polymer Modification", retrieved on Dec. 6, 2019, <https://www.dow.com/en-us/pdp.engage-7270-olyolefin-elastomer.107430z.html>. (Year: 2019).*

"Engage 7270 Polyolefin Elastomer", retrieved on Dec. 6, 2019, <https://www.dow.com/en-us/pdp.engage-7270-polyolefin-elastomer.107430z.html>. (Year: 2019).*

* cited by examiner

TENNIS BALL

BACKGROUND

Tennis balls are typically pressurized to enhance rebound or bounce performance. As a pressure in the ball decreases, the tennis balls lose rebound or bounce performance. This loss is accelerated by play. As a result, the tennis balls must often be replaced. Prior to initial use, such tennis balls must be packaged in pressurized containers to maintain their performance characteristics prior to such initial use.

Figure 1:
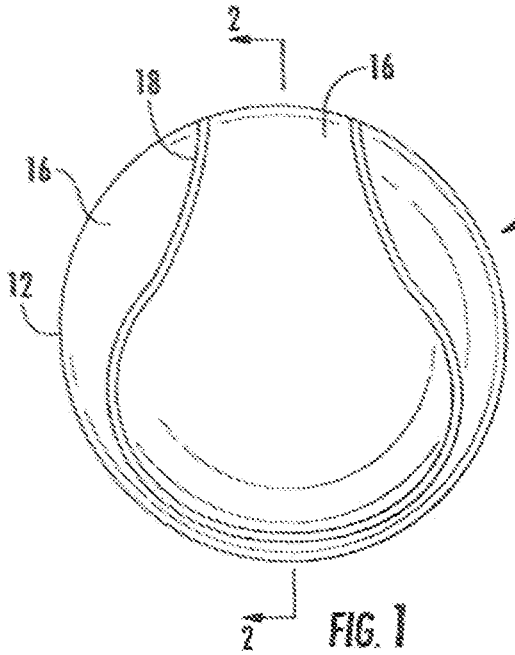
FIG. 1 is a perspective view of an example tennis ball.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed herein are examples of tennis balls that maintain performance over longer periods of time and play, increasing the longevity of the tennis ball. The increased playable life of such tennis balls reduces waste, and reduces the frequency in which players, club and/or organizations purchase replacement tennis balls. Disclosed herein are example low-pressure tennis balls that have performance characteristics similar to higher pressurized tennis balls, facilitating the packaging of such tennis balls in lower pressure or pressure-less packages. Disclosed herein are example tennis balls that exhibit the performance of a premium tennis ball and maintain that high level of performance over prolonged periods of time.

Disclosed herein are example tennis balls having characteristics that satisfy standards and regulations pertaining to tennis balls utilized in competitive play as established by the United States Tennis Association and International Tennis Federation while, at the same time, providing such enhanced performance longevity. For purposes of this disclosure, a "competitive play tennis ball" means a tennis ball that satisfies the following specifications as currently published by the International Tennis Federation and set forth below.

a. The ball shall have a uniform outer surface consisting of a fabric cover except for the Stage 3 (Red) foam ball. If there are any seams they shall be stitchless.

b. The ball shall conform to one of types specified in the table immediately below or in the table under paragraph (d).

| — | Type 1 (Fast) | Type 2 (Medium)[1] | Type 3 (Slow)[2] | High Altitude[3] |
|---|---|---|---|---|
| Mass (Weight) | 56.0-59.4 g (1.975-2.095 oz) | 56.0-59.4 g (1.975-2.095 oz) | 56.0-59.4 g (1.975-2.095 oz) | 56.0-59.4 g (1.975-2.095 oz) |
| Size | 6.54-6.86 cm (2.57-2.70 in) | 6.54-6.86 cm (2.57-2.70 in) | 7.00-7.30 cm (2.76-2.87 in) | 6.54-6.86 cm (2.57-2.70 in) |
| Rebound | 138-151 cm (54-60 in) | 135-147 cm (53-58 in) | 135-147 cm (53-58 in) | 122-135 cm (48-53 in) |
| Forward Deformation[4] | 0.56-0.74 cm (0.220-0.291 in) | 0.56-0.74 cm (0.220-0.291 in) | 0.56-0.74 cm (0.220-0.291 in) | 0.56-0.74 cm (0.220-0.291 in) |
| Return Deformation[4] | 0.74-1.08 cm (0.291-0.425 in) | 0.80-1.08 cm (0.315-0.425 in) | 0.80-1.08 cm (0.315-0.425 in) | 0.80-1.08 cm (0.315-0.425 in) |
| Colour | White or Yellow | White or Yellow | White or Yellow | White or Yellow |

Notes:

[1]This ball type may be pressurised or pressureless. The pressureless ball shall have an internal pressure that is no greater than 7 kPa (1 psi) and may be used for high altitude play above 1,219 m (4,000 feet) above sea level and shall have been acclimatised for 60 days or more at the altitude of the specific tournament.

[2]This ball type is also recommended for high altitude play on any court surface type above 1,219 m (4,000 feet) above sea level.

[3]This ball type is pressurised and is an additional ball specified for high altitude play above 1,219 m (4,000 feet) above sea level only.

[4]The deformation shall be the average of a single reading along each of three perpendicular axes. No two individual readings shall differ by more than 0.08 cm (0.031 inches).

c. In addition, all ball types specified under paragraph (b) shall conform to the requirements for durability as shown in the following table:

| — | Mass (Weight) | Rebound | Forward Deformation | Return Deformation |
|---|---|---|---|---|
| Maximum Change[1] | 0.4 g (0.014 oz) | 4.0 cm (1.6 in) | 0.08 cm (0.031 in) | 0.10 cm (0.039 in) |

Notes:

[1]The largest permissible change in the specified properties resulting from the durability test described in the current edition of *ITF Approved Tennis Balls, Classified Surfaces & Recognised Courts*. The durability test uses laboratory equipment to simulate the effects of nine games of play.

d. Only the ball types specified in the table below can be used in 10 and under tennis competition:

| — | Stage 3 (Red) Foam | Stage 3 (Red) Standard | Stage 2 (Orange) Standard | Stage 1 (Green) Standard |
|---|---|---|---|---|
| Mass (Weight) | 25.0-43.0 g (0.882-1.517 oz) | 36.0-49.0 g (1.270-1.728 oz) | 36.0-46.9 g (1.270-1.654 oz) | 47.0-51.5 g (1.658-1.817 oz) |
| Size | 8.00-9.00 cm (3.15-3.54 in) | 7.00-8.00 cm (2.76-3.15 in) | 6.00-6.86 cm (2.36-2.70 in) | 6.30-6.86 cm (2.48-2.70 in) |
| Rebound | 85-105 cm (33-41 in) | 90-105 cm (35-41 in) | 105-120 cm (41-47 in) | 120-135 cm (47-53 in) |
| Forward Deformation[1] | — | — | 1.40-1.65 cm (0.551-0.650 in) | 0.80-1.05 cm (0.315-0.413 in) |
| Colour[2] | Any | Red and Yellow, or Yellow with a Red dot | Orange and Yellow, or Yellow with an Orange dot | Yellow with a Green dot |

Notes:
[1]The deformation shall be the average of a single reading along each of three perpendicular axes. There is no limit on the difference between individual forward deformation readings. There is no specification for return deformation.
[2]All coloured dots shall be reasonable in size and placement.

e. All tests for rebound, mass, size, deformation and durability shall be made in accordance with the Regulations described in the current edition of *ITF Approved Tennis Balls, Classified Surfaces & Recognised Courts.*

Disclosed herein are example tennis balls that are more environmentally friendly. The disclosed tennis balls last significantly longer, reducing waste. The longer useful life of the example tennis balls allows for players to use the balls for a longer period of time, thereby discarding fully used balls and obtaining replacement balls less frequently than conventional tennis balls. The disclosed tennis balls maintain performance at or near atmospheric pressure such that the tennis balls may be packaged in low pressure or non-pressurized packages, as a result, the example tennis balls may be packaged in more environmentally friendly packaging.

The disclosed tennis balls are further ideal for tennis clubs or other locations where a large number of tennis balls are often placed into bins or baskets for lessons and/or practice. As a result, different balls may have different performance characteristics depending upon their age and wear, providing inconsistent performance. Such inconsistency amongst the balls may make lessons and practice less productive and less enjoyable. The different ages of the different tennis balls in such baskets may further present a challenge for clubs or resorts to maintain baskets and bins with playable balls. The disclosed tennis balls have performance longevity such that they do not experience substantial performance degradations over time. Because the disclosed tennis balls will have a useful playable life of six months or more, the large number of tennis balls contained in such baskets or packages may have more consistent and uniform performance characteristics.

Disclosed herein are example tennis balls that may include a spherical hollow elastomeric core having a specific gravity of less than 1.0 and a thickness of at least 4.5 mm and a textile layer covering the spherical hollow core. For purposes of this disclosure, "specific gravity" is a ratio of the density of the substance to the density of a reference substance, namely, water, at room temperature and atmospheric pressure.

Disclosed herein are example tennis balls that comprise a spherical hollow elastomeric core and a textile layer covering the spherical hollow core. The tennis balls are competitive play tennis balls in that the tennis balls have characteristics that satisfy United States Tennis Association and International Tennis Federation standardized specifications as published by the International Tennis Federation as of Jul. 1, 2018. The competitive play tennis balls exhibit a rebound percentage decline of less than 4% after four months of nonuse and exposure to atmospheric pressure. In other implementations, the competitive play tennis balls exhibit a rebound percentage decline of less than 3% after four months of nonuse and exposure to atmospheric pressure.

Disclosed herein are example tennis ball packages that comprise a package at a pressure of no greater than 5 psi and a set of tennis balls within the package. Each of the tennis balls exhibits a rebound percentage decline of less than 4% after four months of nonuse and exposure to atmospheric pressure upon removal from the sealed package. In other implementations, the competitive play tennis balls exhibit a rebound percentage decline of less than 3% after four months of nonuse and exposure to atmospheric temperature.

Disclosed herein are example tennis ball packages that comprise a package at a pressure of no greater than 10 psi and a plurality of tennis balls within the package. At least one of the plurality of tennis balls has a first tennis ball coefficient of restitution value of at least 0.53 when measured from an initial velocity of 90 feet/second within 1 hour of the at least one of the plurality of tennis balls being initially removed from the tennis ball package and unused, and a second tennis ball coefficient of restitution value measured from an initial velocity of 90 feet/second after the at least one of the plurality of tennis balls is exposed to atmospheric pressure for four months. The second coefficient of restitution value is at least 95 percent of the first coefficient of restitution value.

Figure 2:
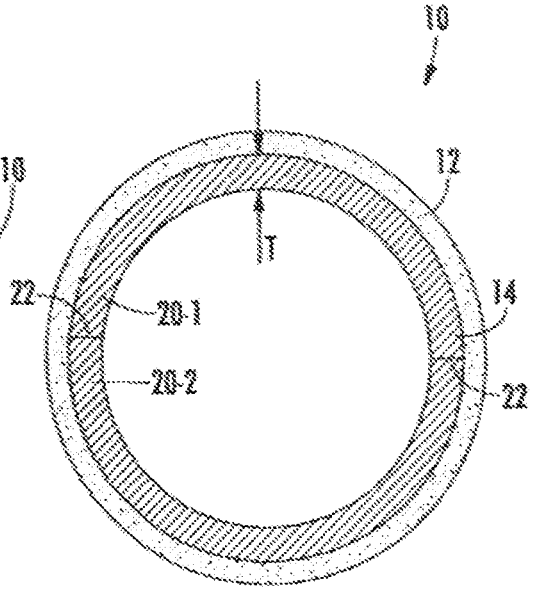
FIG. 2 is a sectional view of the tennis ball of FIG. 1 taken along line 2-2.
Figure 3:
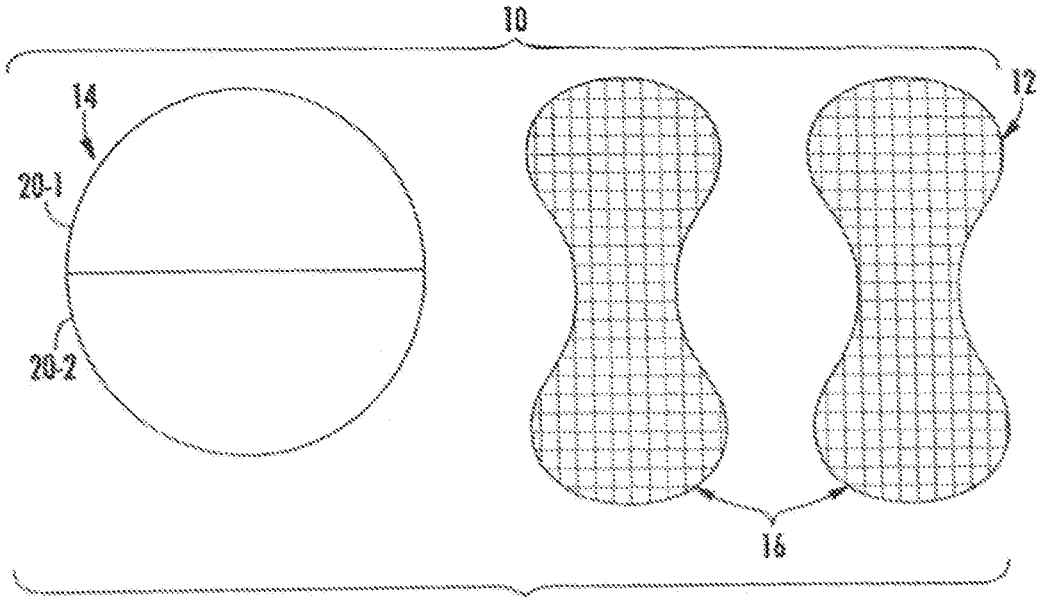
FIG. 3 is an exploded side view of the tennis ball of FIG. 1.

FIGS. 1-3 illustrate an example tennis ball 10. FIG. 1 is a perspective view of tennis ball 10. FIG. 2 is a sectional view of tennis ball 10 taken along line 2-2 of FIG. 1. FIG. 3 is an exploded view of tennis ball 10 Tennis ball 10 maintains performance over longer periods of time and play, increasing the longevity of the tennis ball 10. Tennis ball 10 has performance characteristics similar to higher pressurized tennis balls, facilitating the packaging of tennis ball 10 in lower pressure packages. Tennis ball 10 may be manufactured in warmer environments or packaged in warmer environments with less risk of a negative or vacuum pressure occurring within the tennis ball 10 when at room temperature or at lower temperatures. Tennis ball 10 may be packaged in less pressurized or in unpressurized packages while maintaining performance over prolonged periods of time.

As shown by FIGS. 1 and 2, tennis ball 10 comprises outer textile layer 12 and core 14. Outer textile layer 12 comprises at least one layer of fabric material secured over and about core 14. As shown by FIGS. 1 and 3, in one implementation, outer textile layer 12 comprises two internested "stadium-shaped" shaped panels 16 of textile material bonded to core 14 (as shown in FIGS. 2 and 3) along seams 18. In other implementations, outer textile layer 12 may be provided by panels having other shapes, such as, for example, dog bone-shaped. In some implementations, textile layer 12 may be formed by fibers not provided in the form of panels, but which are individually or collectively joined or bonded to core 14.

In one implementation, tennis ball 10 may be formed by bathing or coating the core 14 in an adhesive, such as a synthetic or natural rubber adhesive. In such an implementation, the outer edges of at least one of the two dog-bone or stadium shaped panels 16 of textile material are coated with an adhesive, such as a synthetic or natural rubber adhesive. The dog-bone shaped panels 16 are then applied over and to the core 14 with the edges of the dog-bone shaped panels 16 in abutment or close proximity along a seam comprised of the bonding adhesive, while the adhesives are in an adhesive state to form the tennis ball shown in FIG. 1. The adhesive is then allowed to dry or cure.

In one implementation, outer textile layer 12 comprises a layer of fiber material such as felt. In one implementation, outer textile layer 12 comprise a woven fiber material. In one implementation, outer textile layer 12 comprises a needle-punched fiber material. In yet other implementations, outer textile layer 12 may comprise other materials.

In one such implementation, the outer textile layer comprises a layer of felt adhered core 14 using a rubber-based adhesive. The felt applied to the cover may comprise woven fiber material or needle punched felt. Felt may comprise natural fiber (such as wool), synthetic fiber (such as nylon) or a mixture thereof. In one implementation, the felt cover may comprise a needle-punched felt comprising fiber having a wool content of 70% and a nylon content 30%. The needle punched felt may have a high level of elongation. For example, the felt can have a diagonal direction elongation of greater than 12% under an applied load of five psi. In other implementations, other mixtures of natural and synthetic fibers can be used. In other implementations, felts having other elongation values can be used.

Core 14 comprises a hollow spherical structure having a spherical wall formed from a rubber or rubber-like material. In one implementation, core 14 is formed from two semi-spherical halves or half shells 20-1, 20-2 which are molded, joined and/or bonded together. In one implementation, an adhesive 22, such as a natural rubber or synthetic rubber adhesive, can be used to join or bond the half shells 20-1 and 20-2 together. In one implementation, the two semi spherical halves or half shells 20-1, 20-2 are joined in a pressure chamber so the interior of the joined halves is pressurized. In one implementation, the two semi-spherical halves or half shells 20-1, 20-2 are adjoined in a pressure chamber such that the interior of the joined halves has a pressure of no greater than five psi. In other implementations, the internal pressure of the formed core can be approximately, four psi, three psi, two psi or 1 psi. In other implementations, core 14 may be formed in other manners. In some implementations, core 14 may additionally incorporate a valve that facilitates pressurization of the interior of core 14. In other implementations, the core 14 may be formed in a non-pressurized chamber and pressurized during the molding or curing process without the use of a valve attached to the core.

In the example illustrated, core 14 has a thickness T (shown in FIG. 2) of at least 4.8 mm. In one implementation, the thickness T of core 14 is at least 4.8 mm and no greater than 5.1 mm. In another implementation, the core can have a thickness T of at least 4.5 mm. The core thickness of a conventional pressurized tennis ball core is approximately 3.5 mm. The core has a specific gravity of less than 1.0. In one implementation, the specific gravity is approximately 0.985. In other implementations, the formulation of the core can have a specific gravity of 0.99 or less. In other limitations, the core can have a density of less than or equal to 1.0 $g/cm^3$.

In one implementation, core 14 comprises an ethylene copolymer having a specific gravity of less than 0.9. In one implementation, the ethylene copolymer has a specific gravity of less than 0.9, a flexural modulus of less than 35 MPA and a shore D hardness of less than 30. In another implementation, the flexural modulus of the ethylene copolymer can be less than or equal to 25 MPA. The core 14 can include one more ethylene copolymers. The alkene of the one or more ethylene copolymers can be a butene, hexene, octene, pentene, heptene, nonene and decene.

In one implementation, the core comprises at least one rubber selected from a group consisting of natural rubber, polybutadiene, polyisoprene, styrene-butadiene rubber and/or mixtures thereof. In some implementations, the core may additionally comprise fillers, activators, accelerators, retardants and the like, a sulfur vulcanizing agent and/or an ethylene copolymer having a specific gravity of less than 0.9. In one implementation, the core 14 is formed from a blend of rubbers comprising polybutadiene rubber, natural rubber and styrene-butadiene rubber, and a thermoplastic co-polymer comprising ethylene and butane, zinc oxide as an activator, silica as a filler for weight and a stiffening agent, accelerators, retarders, antioxidants and sulfur to vulcanize the polymer composition.

In some implementations, the ethylene copolymer may comprise copolymers of ethylene with butane, hexane or octane, a blend thereof. Some example materials include, not limited to, the material sold under the trade name ENGAGE® and commercially available from The Dow Chemical Company of Midland, Mich., or a material sold under the trade name EXACT® by Exxon Mobil Corporation of Irving, Tex.

In one implementation, the ethylene copolymer is Dow® ENGAGE® 7270 which is a copolymer of ethylene and butane having a specific gravity of 0.880, a flexural modulus of 22.1 MPA and a durometer on the Shore D hardness scale of 26. In one such implementation, the outer textile layer comprises a layer of felt adhered to the core 14 using a rubber-based adhesive.

One example tennis ball 10 (Example 1) comprises a core 14 comprises Dow® ENGAGE® 7270, a copolymer of ethylene and butane having a specific gravity of 0.880, a flexural modulus of 22.1 MPA and a Shore D hardness or durometer value of 26. The core 14 has a thickness of 4.8 mm. The example tennis ball 10 (Example 1) has an outer textile layer 12 comprising a needle-punched felt formed from a fiber having a wool content of 70% and a nylon continent 30%. The outer textile layer 12 is adhered to the surface of core 14 using a rubber-based adhesive.

Table 1 below illustrates comparison of various properties of the two Example 1 tennis balls (PLB-5B) with that of a Wilson® US OPEN Extra Duty tennis ball produced by Wilson Sporting Goods Co. of Chicago, Ill. The Wilson® US OPEN Extra Duty tennis ball is a top-line commercially available tennis ball configured for competitive play and similar to the tennis balls used at the U.S. Open major tennis tournament.

Tennis ball characteristics and performance data were measured and recorded for sets of 6 tennis balls from each of the two example prototype tennis balls (PLB-5B) and the Wilson® U.S. Open tennis balls. The characteristics and performance data included internal ball pressure, ball size, ball weight, ball deformation, ball rebound height, and coefficient of restitution (COR) values taken from various inbound ball speeds.

Internal ball pressure is measured by puncturing the surface of the ball with a needle attached to a pressure gauge. Tennis ball deformation is measured using a Stevens Machine by Redland of Crawley, England, or a conventional automatic compression machine. A Stevens Machine for measuring tennis ball deformation is a compression machine designed by Percy Herbert Stevens and patented under GB Patent No. 230250. Tennis ball deformation is measured by placing the tennis ball into the compression machine and applying a pre-load compressive force of 3.5 lbf to the ball and zeroing the deformation indicator of the compression machine, then applying an additional compressive load of 18.0 lbf and recording the deformation of the ball with respect to the initial pre-load deformation value. Three deformation readings are taken on each ball with the ball rotated 90 degrees between each reading/measurement.

configured for competitive play typically have rebound characteristics falling within the range of 53 to 58 inches, and a range of 48 to 53 inches for play in high altitude conditions. The term "tennis ball rebound height" shall mean a measurement of the maximum height of the bottom of a tennis ball recorded after the tennis ball is dropped from an initial height of 100 inches above a granite plate having a smooth surface.

Tennis ball COR measurements are taken by projecting the ball at an initial velocity (e.g. 60 fps, 90 fps or 120 fps) off of a rigidly mounted, vertically positioned steel plate having a smooth surface and a thickness of 1 inch, and measuring the velocity of the ball rebounding from the steel plate using light gates, such as model ADC VG03 by Automated Design Corporation of Romeoville, Ill. The tennis balls can be projected using a pneumatic cannon, such as an ADC Air Cannon by Automated Design Corporation of Romeoville, Ill., or other comparable ball launching apparatus to obtain the initial ball speeds of 60 fps, 90 fps or 120 fps. The term "tennis ball coefficient of restitution value" means a tennis ball COR measurement taken from a specified initial velocity off of a vertically positioned, rigidly mounted steel plate having a smooth surface and measuring the velocity of the ball rebounding from the steel plate using light gates.

TABLE 1

Request No.: B180131
Date: Jan. 31, 2018
Name: Cacloppo

| | | UNIS TARGET SPECS. (Pressurized) | QTY | PLB-5B Smaller Tooling No Expancel Pressurized Can | PLB-5B Smaller Tooling Expancel Foam Pressurized Can | T1062 US Open Extra Duty Control | COMMENTS |
|---|---|---|---|---|---|---|---|
| CORE | | | 6 | PLB-5B | PLB-5B | U-005S | |
| COMPOUND | | | | | | | |
| WALL THICKNESS | | | 6 | 4.8 mm | 4.8 mm | 3.4 mm | |
| FELT | | | 6 | 3602N | 3602N | 3336 | |
| LOGO | | | 6 | US Open 1 | US Open 3 | US Open 4 | |
| CAN PRESS. | Avg. | 13.0-15.0 | 6 | 6.7 | 6.0 | 14.7 | |
| (psi) | Stdev. | | | 0.1 | 0.1 | 0.1 | |
| BALL PRESS. | Avg. | 12.0-14.0 | 6 | 4.5 | 3.7 | 13.8 | |
| AFTER COR | Stdev. | | | 0.1 | 0.1 | 0.2 | |
| SIZE: | Avg. | 2.600-2.680 | 6 | 2.623 | 2.620 | 2.647 | High Rebound |
| (in.) | Stdev. | | | 0.010 | 0.000 | 0.008 | w/ Zero G USO 1 |
| WEIGHT: | Avg. | 56.0-59.5 | 6 | 57.0 | 57.5 | 58.1 | |
| (g) | Stdev. | | | 0.4 | 0.4 | 0.6 | |
| DEFORM.: | Avg. | .230-.260 | 6 | .228 | .234 | .233 | |
| (in.) | Stdev. | | | 005 | 004 | .005 | |
| REBOUND: | Avg. | 54.0-58.0 | 6 | 60.3 | 58.3 | 57.9 | |
| (in.) | Stdev. | | | 0.5 | 0.2 | 0.5 | |
| COR @ 60 fps | Avg. | | 6 | .653 | .648 | .664 | |
| | Stdev. | | | 008 | .010 | .010 | |
| COR @90 fps | Avg. | | 6 | .543 | .524 | .559 | |
| | Stdev. | | | .008 | .008 | .008 | |
| COR @ 120 fps | Avg. | | 6 | .463 | .442 | .486 | |
| | Stdev. | | | .006 | .007 | .008 | |
| MOI (oz.-in 2) | Avg. | | 6 | 1.776 | 1.761 | 1.931 | Zero G was |
| (Moment of Inertia) | Stdev. | | | .021 | .014 | .029 | 8.0% Lower in MOI than US Open Control Ball |

Tennis ball rebound height is measured from the bottom of a tennis ball being vertically dropped from a height of 100 inches off of a granite plate having a smooth surface and a thickness of at least 1.25 inches. As stated above, tennis balls As shown above, the two tested Example 1 tennis balls (PLB-5B) have similar performance characteristics as that of the pressurized Wilson® US OPEN tennis balls except for moment of inertia (MOI) of the tennis balls. The Example 1 tennis balls exhibit a MOI that is 8 percent lower than the Wilson® US OPEN tennis balls tested. This greater wall thickness of core 14 of the Example 1 tennis balls contributes to the reduced MOI values as compared to the wall thickness of the Wilson® US OPEN tennis balls. The lower MOI can facilitate the application of spin to the Example 1 tennis balls. The ability for a player to impart spin to a tennis ball during play is important for many tennis players, particularly highly skilled tennis players who often impart topspin to the ball upon impact during play. Two groups of tennis balls under PLB-5B were prepared, one group incorporated Expancel foam during its manufacture and the other group was produced without the use of Expancel foam. Expancel comprises microspheres that expand under heat to up to 40 times their size. The microspheres can be placed inside core shells prior to molding and then expand under heat to fill the volume within the molded core during the molding process. In some core compositions, Expancel can improve the sound characteristics of the ball. Expancel foam is produced by AkzoNobel Chemical Products. Test results indicate that the use of Expancel is not necessary when an ethylene-butene copolymer such as Engage is incorporated into the core composition.

In one implementation, the tennis ball can have a moment of inertia of less than 1.85 oz-in$^2$. In other implementations, the tennis ball can have a moment of inertia of less than 1.80 oz-in$^2$. The tennis balls built in accordance with a present implementation of the present invention can have a lower MOI than conventional tennis balls and therefore allow for a player to more easily impart spin to the ball during use, thereby improving the player's control and/or the player's ability to hit the ball harder while keeping the ball in play.

Table 2 below is a summary of the properties of the example tennis ball 10 (Example 1) with respect to a commercial Wilson® US OPEN tennis ball, a premium pressurized tennis ball having an internal pressure of approximate 13 psi.

TABLE 2

| Physical Properties: | | | | | | | | |
|---|---|---|---|---|---|---|---|---|
| | | | | | | C.O.R. | | |
| Ball | Press. | Size | Wt. | Def. | Reb | 60 f/s | 90 f/s | 120 f/s |
| Example 1 (ZERO G) | 3.7 | 2.623" | 57.0 | 0.234" | 58.6 | 0.653 | 0.543 | 0.463 |

TABLE 2-continued

| Physical Properties: | | | | | | | | |
|---|---|---|---|---|---|---|---|---|
| | | | | | | C.O.R. | | |
| Ball | Press. | Size | Wt. | Def. | Reb | 60 f/s | 90 f/s | 120 f/s |
| Wilson ® US Open | 13.8 | 2.647" | 58.1 | 0.233" | 57.6 | 0.664 | 0.559 | 0.486 |

As shown above, the Example 1 tennis ball has an internal pressure of 3.7 psi, significantly lower than the Wilson® US Open tennis ball, and other commercially available tennis balls used in competitive play. The Example 1 tennis ball also has size, weight, deformation and rebound characteristics that are comparable to the WILSON® US OPEN tennis ball and is a competitive tennis ball, within the requirements set forth by the USTA and the ITF. Example 1 tennis ball also has coefficient of restitution properties that are comparable to a pressurized tennis ball, the WILSON® US OPEN tennis ball.

The Example 1 tennis ball has prolonged performance longevity as compared to the WILSON® US OPEN tennis ball. Table 3 below provides permeation data for the Example 1 tennis balls and the WILSON® US OPEN tennis balls at different times following removal of the tennis balls from their respective pressurized packages or cans.

TABLE 3

| | | | OUT-of-CAN 1, 2, 3, 4, 5, and 6 months | | | | | | |
|---|---|---|---|---|---|---|---|---|---|
| BALL | PARAMETER | QTY. | Initial | (1) mo. | (2) mo. | (3) mo. | (4) mo. | (5) mo. | (6) mo. |
| WRT1062 US Open (Contol) | BALL PRESS.: (psi) | 6 | 13.7 | 11.2 | 9.0 | 7.6 | — | — | — |
| | REBOUND: (in.) | 6 | 56.3 | 55.3 | 54.5 | 52.8 | — | — | — |
| WRT1062 US Open (Contol) | BALL PRESS.: (psi) | 6 | 13.4 | — | 8.8 | — | 6.5 | — | May 7, 2018 |
| | REBOUND: (in.) | 6 | 57.5 | — | 54.3 | — | 54.5 | — | May 7, 2018 |
| ZERO G PLB-5 (4.1) mm | BALL PRESS.: (psi) | 6 | 4.3 | 3.1 | 1.9 | 1.2 | — | — | — |
| | REBOUND: (in.) | 6 | 59.7 | 60.3 | 60.0 | 59.6 | — | — | — |
| ZERO G PLB-5B (4.8) mm | BALL PRESS.: (psi) | 6 | 4.9 | — | 1.8 | — | 1.1 | — | 0.7 |
| | REBOUND: (in.) | 6 | 58.8 | — | 57.7 | — | 57.2 | — | 57.8 |

As demonstrated by Table 3 above and the graph and Table 4 below, the tennis balls made in accordance with an implementation of the present application, maintain their rebound height over time. In particular, the rebound height is at least 96% of the initial rebound height even after 4 months of the balls being maintained in an atmospheric pressure environment. In another implementation, the rebound is height is at least 97% of the initial rebound height after four months of being maintained in an atmospheric pressure environment. In one implementation, the height of the rebound of an Example prototype tennis ball from the surface, has a first tennis ball rebound height that is recorded by measuring the rebound of the tennis ball within 1 hour of being initially removed from the tennis ball package and unused, and a second tennis ball rebound height that is recorded by measuring the rebound of the tennis ball after the tennis ball is exposed to atmospheric pressure for four months and unused, and the second rebound height at least 96% of the first rebound height. In another implementation, the second rebound height is at least 97% of the first rebound height.

Figure 5:
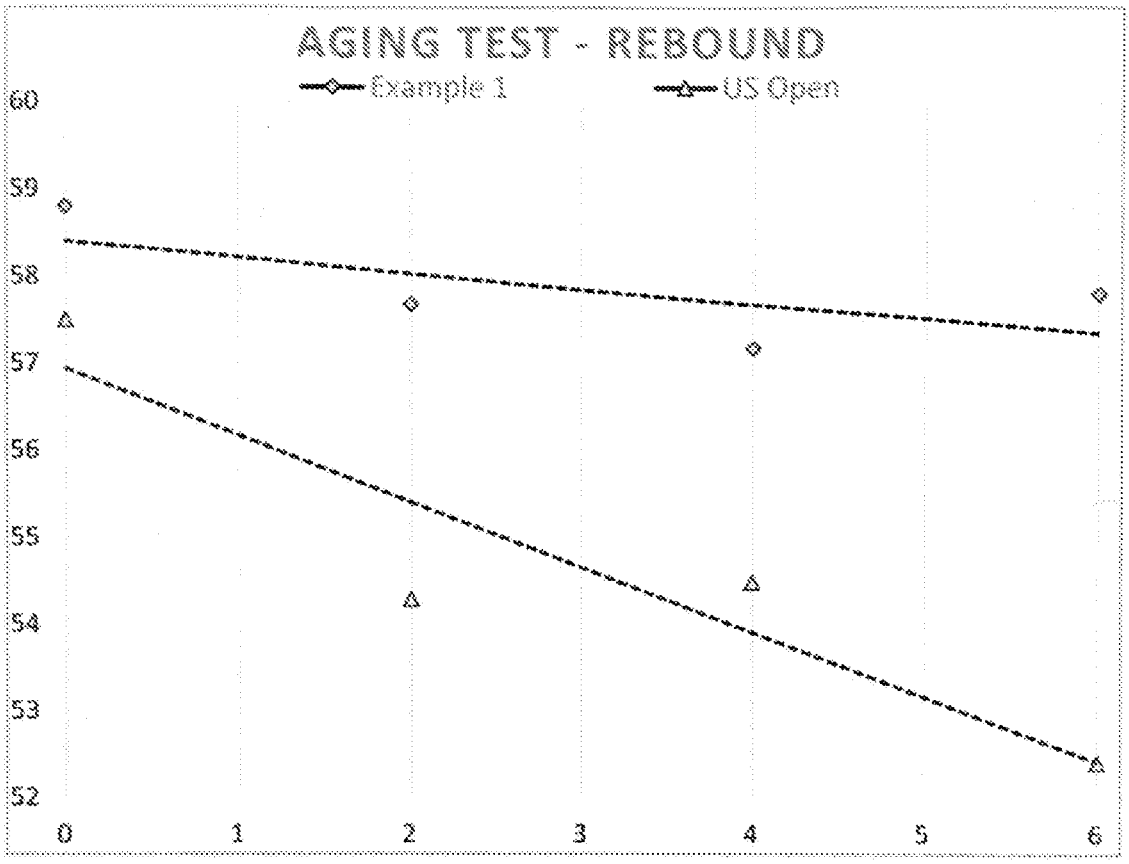
FIG. 5 is a graphical representation of the rebound values of a US Open tennis ball and an Example tennis ball over time.

The graph of FIG. 5 provides a comparison between the Example 1 and WILSON® US OPEN tennis balls which were tested for rebound within 1 hour after being initially removed from pressurized cans and unused and then re-measured after two-month intervals. In the example illustrated, the Example 1 tennis balls were initially pressurized at a pressure of no greater than 7 psi (6.7 psi and 6.0 psi) whereas the WILSON® US OPEN tennis balls were contained in cans were initially pressurized at a pressure of 14.7 psi.

As shown in by Table 3 and the figure above, the Example 1 tennis balls maintain rebound performance, exhibiting a rebound percentage decline of less than 3% after four months of nonuse and exposure to atmospheric pressure upon removal from the sealed package/pressurized can. In contrast, the WILSON® US OPEN tennis balls exhibit a loss of approximately 5.4% over two months, twice the loss in rebound as compared to the Example 1 balls in half of the aging time.

The surprising and unexpected results indicate that Example 1 with a significant thicker shell or core construction of at least 4.8 mm and an internal pressure of less than 5 psi exhibit performance comparable to a conventional high performance pressurized tennis ball (the WILSON® US OPEN tennis ball). At the same time, the Example 1 tennis ball maintains performance significantly longer than the conventional tennis ball. As a result, the Example 1 tennis ball may be played longer in terms of play as well as last longer for a player who plays recreationally as new balls would not necessarily be required each time that the recreational player desires to play.

Moreover, because the Example 1 tennis balls have performance longevity in an atmospheric or non-pressurized environment, such balls may be stored and contained in sealed packages at a lower pressure or in unsealed packages with no pressure for significant periods of time without significant performance degradation. As a result, the Example 1 tennis balls may be packaged in lower pressurized packages or non-pressurized packages, reducing packaging cost and complexity.

Table 4 below provides various tennis ball characteristics and performance data including internal ball pressure, weight, size, rebound, deformation, coefficient of restitution (COR) and permeation data for: (1) a set of six PENN® CHAMPIONSHIP extra duty tennis balls produced by Head Technology GmbH of Austria; (2) a set of six DUNLOP® championship all court tennis balls produced by Dunlop International Europe Ltd. of England; (3) a set of six WILSON® U.S. OPEN extra duty tennis balls; and (4) a set of six ZERO G PROTOTYPE tennis balls built in accordance with an implementation of the present application. The internal ball pressure, size, weight, deformation, rebound height, and COR values at different initial speeds taken of each of these tennis balls were measured when the balls were initially removed from their respective containers. The initial measurements were made within 1 hour of being initially removed unused from the tennis ball containers. The ball pressure, size, weight, deformation, rebound height and COR values were then re-measured after monthly time intervals. The tennis balls were unused except for performing the above-listed measurements.

TABLE 4

COR PERMEATION TEST

| | Time Out of Can | Ball Press. (psi) | Size (in) | Wght (g) | Def. (in) | Rbnd (in) | Cum. Rbnd Loss (in) | COR @ 60 fps | COR @ 90 fps | COR @ 120 fps |
|---|---|---|---|---|---|---|---|---|---|---|
| Penn | Init. | 12.2 | 2.638 | 57.8 | .224 | 57.9 | | .663 | .559 | .479 |
| Champ | 1 mo. | 9.1 | 2.630 | 57.2 | .234 | 54.3 | 3.6 | .628 | .522 | .438 |
| Extra Duty | 2 mo. | 7.5 | 2.618 | 57.5 | .233 | 54.5 | 3.4 | .620 | .519 | .440 |
| Balls (Avg. | 3 mo. | 6.4 | 2.612 | 57.3 | .249 | 52.3 | 5.6 | .606 | .521 | .430 |
| of 6 balls) | 4 mo. | 5.0 | 2.613 | 57.7 | .245 | 51.6 | 6.3 | .607 | .506 | .424 |
| Dunlop | Init. | 9.5 | 2.600 | 58.4 | .244 | 56.8 | | .637 | .542 | .454 |
| Champ All | 1 mo. | 7.4 | 2.592 | 58.1 | .252 | 54.8 | 2.0 | .626 | .522 | .444 |
| Court Balls | 2 mo. | 6.2 | 2.595 | 58.5 | .265 | 53.6 | 3.2 | .622 | .507 | .430 |
| (Avg. of 6 | 3 mo. | 5.4 | 2.588 | 58.5 | .272 | 52.3 | 4.5 | .617 | .501 | .424 |
| balls) | 4 mo. | 4.4 | 2.584 | 58.4 | .276 | 52.1 | 4.7 | .608 | .500 | .418 |
| Wilson US | Init. | 13.0 | 2.647 | 57.6 | .231 | 57.5 | | .651 | .556 | .480 |
| Open Extra | 2 mos. | 8.8 | 2.623 | 56.9 | .254 | 54.3 | 3.2 | .640 | .524 | .450 |
| Duty Balls | 4 mos. | 6.5 | 2.617 | 56.9 | .261 | 54.5 | 3.0 | .613 | .513 | .440 |
| (Avg. of 6 | 6 mos. | 4.1 | 2.607 | 57.1 | .275 | 52.4 | 5.1 | .592 | .484 | .408 |
| balls) | | | | | | | | | | |
| Zero G | Init. | 4.9 | 2.697 | 58.6 | .221 | 58.8 | | .649 | .542 | .454 |
| Proto-type | 2 mos. | 1.8 | 2.695 | 57.9 | .222 | 57.7 | 1.1 | .641 | .524 | .439 |
| Balls (Avg. | 4 mos. | 1.1 | 2.700 | 58.0 | .229 | 57.2 | 1.6 | .621 | .522 | .434 |
| of 6 balls) | 6 mos. | 0.7 | 2.695 | 57.9 | .231 | 56.8 | 2.0 | .621 | .522 | .434 |

As shown by Table 4 above, the PENN® and DUNLOP® tennis balls under test also experience substantial performance degradation upon removal from their pressurized cans over prolonged periods of time. For example, the rebound height of the PENN® CHAMPIONSHIP extra duty tennis balls dropped by over 6 percent after 1 month, approximately 10 percent after 3 months, and over 10 percent after 4 months. Similarly, the DUNLOP® championship all court tennis balls exhibited a drop in rebound height of over 3.5 percent after 1 month and approximately 8 percent after 3 months. In contrast, the ZERO G PROTOTYPE tennis balls exhibit a rebound height reduction of less than 1.9 percent after 2 months, less than 2.8 percent after 4 months.

Accordingly, at least one of the tennis balls can be tested for rebound by vertically dropping the ball from a height of 100 inches off of a granite plate having a smooth surface and measuring the height of the rebound of the bottom of the tennis ball from the smooth surface. A first tennis ball rebound height can be recorded by measuring the rebound of the tennis ball within 1 hour of being initially removed from the tennis ball package and unused. A second tennis ball rebound height can be recorded by measuring the rebound of the tennis ball after the tennis ball is exposed to atmospheric pressure for four months and unused. In one implementation, the second rebound height is at least 96% of the first rebound height. In another implementation, the second rebound height is at least 97% of the first rebound height.

Additionally, the tennis ball deformation of the PENN® CHAMPIONSHIP extra duty tennis balls and the DUNLOP® championship all court tennis balls also significantly degraded after being removed from their pressurized containers and maintained in an environment of atmospheric pressure. The PENN® CHAMPIONSHIP extra duty tennis balls exhibited an increase in tennis ball deformation after 1 month of over 4 percent, an increase in tennis ball deformation after 2 months of over 4 percent, and increase in tennis ball deformation after 3 months of over 11 percent. The DUNLOP® championship all court tennis balls exhibited an increase in tennis ball deformation after 1 month of over 3 percent, an increase in tennis ball deformation after 2 months of over 8.5 percent, an increase in tennis ball deformation after 3 months of over 11 percent, and an increase in tennis ball deformation after 4 months of over 13 percent. In contrast, the ZERO G PROTOTYPE tennis balls exhibit an increase in tennis ball deformation after 2 month of less than 0.5 percent, and increase in tennis ball deformation after 4 months of less 3.7 than percent.

Accordingly, when at least one of the tennis balls is tested for deformation by applying a 3.5 lbf compressive pre-load to the ball and recording a pre-load deformation value and then an additional compressive load of 18.0 lbf is applied and a second deformation value is recorded, a tennis ball deformation can be calculated by subtracting the pre-load deformation value from the second deformation value. A first tennis ball deformation can be recorded by measuring the tennis ball deformation of the tennis ball within 1 hour of being initially removed from the tennis ball package and unused. A second tennis ball deformation can be recorded by measuring the tennis ball deformation of the tennis ball after the tennis ball is exposed to atmospheric pressure for four months and unused. In one implementation, the second tennis ball deformation is no greater than 0.020 inches from the first tennis ball deformation. In another implementation, the second tennis ball deformation is no greater than 0.015 inches from the first tennis ball deformation. The term "tennis ball deformation" shall mean a deformation value obtained by subtracting a pre-load tennis ball deformation value from a second tennis ball deformation value, wherein the pre-load tennis ball deformation value is measured after applying a 3.5 lbf compressive pre-load to a tennis ball and wherein the second tennis ball deformation value is measured after an additional compressive load of 18.0 lbf is applied to the tennis ball.

Further, the reduction in the coefficient of restitution ("COR") of the PENN® CHAMPIONSHIP extra duty tennis balls and the DUNLOP® championship all court tennis balls is significantly greater after being removed from their pressurized containers and maintained in an environment of atmospheric pressure than the ZERO G PROTOTYPE tennis balls. For example, when tennis balls are projected at a predetermined velocity (e.g., 60 fps, 90 fps or 120 fps) against a vertically positioned, rigidly mounted steel plate having a smooth surface, the exit or return velocity of the tennis balls are measured using light gates. The ratio of the velocity of the tennis balls after impact (outbound) with the velocity of the tennis balls before (inbound) impact is the COR. In one implementation, the velocity of the tennis balls is monitored using light gates, such as a model ADC VG03 produced by Automated Design Corporation of Romeoville, Ill. As shown in Table 4, the COR was measured at the predetermined speeds of 60 fps, 90 fps and 120 fps for each of the balls initially within 1 hour of the balls being initially removed from their respective packaging/containers unused. The COR values of the tennis balls were then retested at the predetermined speeds after the balls had been exposed to an atmospheric pressure environment for periods of 1 or more months.

At a predetermined inbound velocity of 90 fps, the PENN® CHAMPIONSHIP extra duty tennis balls exhibited a decrease in COR after 1 month of over 6.5 percent, a decrease in COR after 2 months of over 7 percent, a decrease in COR after 3 months of approximately 7 percent, and a decrease in COR after 4 months of approximately 10 percent. The DUNLOP® championship all court tennis balls exhibited a decrease in COR after 1 month of over 3.5 percent, a decrease in COR after 2 months of over 6 percent, and a decrease in COR after 3 months of over 7 percent. In contrast, the ZERO G PROTOTYPE tennis balls exhibit a decrease in COR after 2 months of less than 3.5 percent, and a decrease in COR after 4 months and 6 months of less than 4 percent. Accordingly, the ZERO G PROTOTYPE tennis balls exhibit a decrease in COR from an initial COR value of the unused tennis balls to a COR value taken 4 months after the unused tennis balls of 5 percent or less. In other words, a first COR value of at least one of the tennis balls can be taken within 1 hour of being initially removed from the tennis ball package and unused from an initial velocity of 90 feet/second, a second COR value of the tennis ball after the tennis ball is exposed to atmospheric pressure for four months can be recorded from an initial velocity of 90 feet/second, and, in one implementation, the second COR value is at least 95 percent of the first COR value.

Player testing was performed at various locations to determine the playability characteristics between tennis balls formed in accordance with an implementation of the present invention compared to the Wilson® US Open tennis balls, which are representative of a standard premium pressurized tennis ball having an internal pressure of 13 psi. Testing was performed with 103 players having NTRP (National Tennis Rating Program) playing levels as shown in Table 5 below.

TABLE 5

Player Testing - Player Characterization:

| NTRP Rating | # of Players |
|---|---|
| 5.0 or college player | 56 |
| 4.5 | 25 |
| 4.0 | 11 |
| 3.5 or below | 5 |
| Unsure | 6 |

Testing included both men and women college players from DePaul University, Northern Illinois University and the University of Southern California. Players were asked to play both the Wilson® US Open "control" tennis balls and the low pressure balls of Example 1, and then rate the balls for the following attributes: sound, control, feel, consistency of bounce, speed and spin. The player testing results are illustrated in Table 6 below. The Example 1 tennis balls and the Wilson® US Open balls had the same appearance.

TABLE 6

| Player Testing - Results: | | | |
|---|---|---|---|
| | Preference | | |
| Playability Characteristic | Example 1 | None | Wilson ® US Open |
| Sound | 43.7% | 9.7% | 46.6% |
| Control | 44.7% | 9.7% | 45.6% |
| Feel | 41.7% | 11.7% | 46.6% |
| Bounce | 35.9% | 23.3% | 40.8% |
| Speed | 45.6% | 12.6% | 41.7% |
| Spin | 47.6% | 16.5% | 35.9% |
| Overall Preference | 39.8% | 12.6% | 47.6% |

Results of player testing showed the following:

In all playability attributes, there was less than a 5% difference in preference in all categories between the tennis balls of Example 1 and the Wilson® US Open control tennis balls, except for Spin. With respect to spin, the players preferred the tennis balls of Example 1 over the US Open control tennis balls.

The player testing found that approximately 52% of the players preferred the tennis balls of Example 1 or had no preference between the two types of tennis balls.

Player testing illustrated that players felt there is a minimal difference in all playability characteristics with the exception of spin, and that the overall ball preference showed that, although the Wilson® U.S. Open tennis balls were preferred by more players, 40% of players preferred the tennis balls of Example 1 ball and 13% of players had no preference between the two types of tennis balls. Our conclusion is that player testing shows that the Example 1 ball, which had lower initial ball pressure, exhibits comparable performance and is preferred by a significant percentage of players when compared to the U.S. Open premium pressurized tennis balls.

Figure 4:
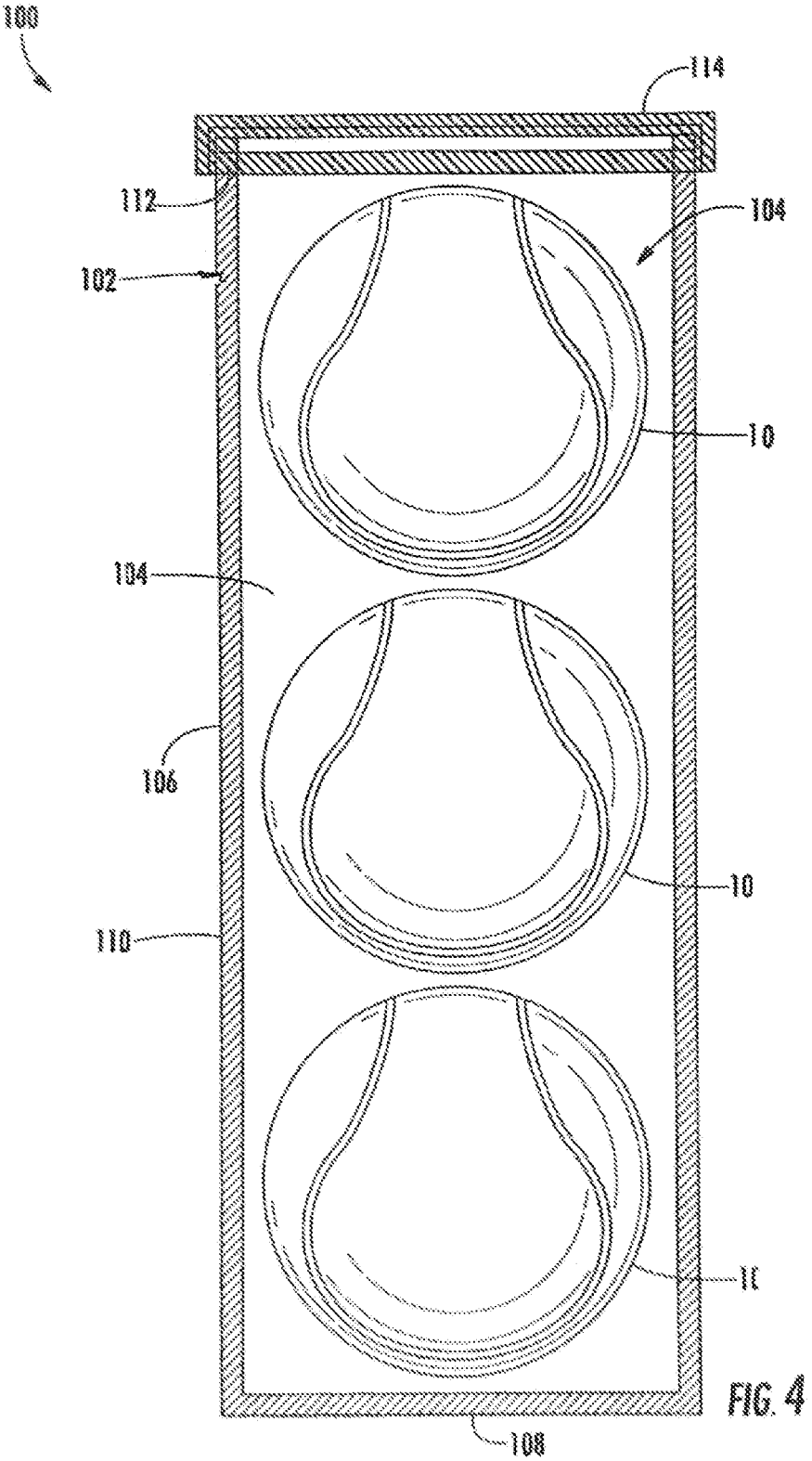
FIG. 4 is a sectional view of an example tennis ball package having a set of the tennis balls of FIG. 1 packaged in a package.

FIG. 4 is a sectional view of an example tennis ball package 100. The package 100 comprises a sealed package 102 and a set 104 of tennis balls 10 (described above). Although package 100 is illustrated as comprising three of such tennis balls 10, in other implementations, package 100 may comprise two tennis balls, four tennis balls, or greater than four tennis balls 10.

The sealed package 102 can comprise a cylindrical can containing tennis balls 10. Sealed package 102 has an interior 106 containing tennis balls 10 and sealed so as to have an internal pressure of no greater than 10 psi. In one implementation, package 102 is sealed so as to have an internal pressure of no greater than eight psi. In another implementation, the package 102 is sealed so as to have an internal pressure of no greater than 5 psi. In other implementations, package 102 is sealed so as to have an internal pressure less than that of the internal pressure of the individual tennis balls 10. In one implementation, package 102 is sealed so as to have an internal pressure equal to atmospheric pressure, the pressure of the ambient environment. In such an implementation, the sealing of package 102 does not maintain the internal pressure of package 102, but merely indicates that such package 100 has not been tampered with or used, being in a "fresh" state.

In the example illustrated, package 102 comprises a cylindrical body 106 having a floor 108 and cylindrical sidewalls 110. The top of body 106 is provided with a top seal 112 and a removable cap or cover 114. The top seal 112 seals the interior 104. In one implementation, the top seal 112 comprises a metallic panel, a portion of which may be scored to facilitate peeling away of portions of the top seal to gain access to the interior 104 and facilitate removal of balls 10. The removable cover 114 resiliently snaps about or pops onto the top of body 106, over the top seal 112. Top seal 112 assist in retaining balls 10 within interior 104 during subsequent use, after top seal 112 has been broken or removed.

As discussed above, the performance longevity of tennis balls 10 allow tennis balls 10 to be packaged in a lower pressure package. In some implementations, the package containing tennis ball 10 may be at atmospheric pressure, eliminating the need to pressurize package 106 during the packaging of tennis balls 10. The lower pressure package 102 reduces the complexity and cost of packaging tennis balls 10. In implementations where package 102 is not pressurized, but is at atmospheric pressure, the top seal 112 may be omitted. In such implementations, tennis balls 10 may undergo post-manufacturing operations at remote sites over space time intervals without such tennis balls having to be initially packaged in a pressurized package and then repackaged again in a pressurized package following such post manufacturing operations. One example such post-manufacturing operations is the application of logos to the exterior of such tennis balls.

Although package 102 is illustrated as a cylindrical can having a metallic ceiling panel and a removable top cap or cover, in other implementations, package 102 may have other configurations. In other implementations, the body 106 of the tennis ball package or container can take other shapes, such as other cylindrical shapes, shapes having polygonal cross-sections, or other geometric shapes.

The ability of tennis balls 10 to have performance longevity at low pressure conditions or at atmospheric pressure facilitates the use of a wide range of packages. For example, in some implementations, package 102 may comprise an air permeable package or an air permeable a net, wherein ceiling mechanisms simply indicate that the sold package has not been tampered with or previously opened, ensuring no prior use of the tennis balls at a point of sale.

Although the present disclosure has been described with reference to example implementations, workers skilled in the art will recognize that changes may be made in form and detail without departing from the spirit and scope of the claimed subject matter. For example, although different example implementations may have been described as including features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A tennis ball comprising:

a spherical hollow elastomeric core having a specific gravity of less than 1 and a thickness of at least 4.5 mm, the spherical hollow core has an initial internal pressure of no greater than 5 psi; and a textile layer covering the spherical hollow core, wherein the tennis ball has a first tennis ball coefficient of restitution value of at least 0.53 when measured from an initial velocity of 90 feet/second at a first time when the tennis ball is unused, and wherein the tennis ball has a second tennis ball coefficient of restitution value measured from an initial velocity of 90 feet/second after the tennis ball is exposed to atmospheric pressure for four months following the first time and is unused, and wherein the second coefficient of restitution value is at least 95 percent of the first coefficient of restitution value.

2. The tennis ball of claim 1, wherein the spherical core comprises a thermoplastic layer of material underlying the textile layer and comprising one or more thermoplastic ethylene copolymers, each having a specific gravity of less than or equal to 0.9.

3. The tennis ball of claim 2, wherein the thermoplastic ethylene copolymer has a flexural modulus of less than 35 MPA and a shore D hardness of less than 30.

4. The tennis ball of claim 3, wherein the thermoplastic ethylene copolymer has a flexural modulus of less than or equal to 25 MPA.

5. The tennis ball of claim 2, wherein the thermoplastic ethylene copolymer is comprised of ethylene and an alkene.

6. The tennis ball of claim 2, wherein the ethylene copolymer includes an alkene selected from the group consisting of butane, hexene, octene, pentene, heptene, nonene and decene.

7. The tennis ball of claim 1, wherein core has a thickness of no greater than 5.1 mm.

8. The tennis ball of claim 1, wherein the core comprises a thermoplastic layer of material underlying the textile layer and comprising:

at least one rubber selected from a group of rubbers consisting of: natural rubber, polybutadiene, isoprene, styrene-butadiene rubber and mixtures thereof; and a thermoplastic ethylene copolymer in an amount of within the range of 10 to 100 parts per hundred with a specific gravity of less than or equal to 0.9.

9. The tennis ball of claim 1, wherein the textile layer comprises a woven fiber material.

10. The tennis ball of claim 1, wherein the textile layer comprises a needle-punched fiber material.

11. The tennis ball of claim 1, wherein the tennis ball is a competitive play tennis ball having characteristics that satisfy United States Tennis Association and International Tennis Federation standardized specifications as published by the International Tennis Federation as of Jul. 1, 2018.

12. The tennis ball of claim 1, wherein the tennis ball has a moment of inertia of less than 1.85 oz $in^2$.

13. The tennis ball of claim 1, wherein the tennis ball has a moment of inertia of less than 1.80 oz $in^2$.

14. The tennis ball of claim 1, wherein the core has a thickness of at least 4.8 mm.

15. The tennis ball of claim 1, wherein the spherical core comprises a thermoplastic material having a specific gravity of less than or equal to 0.9.

16. The tennis ball of claim 1, wherein the tennis ball when unused has a first tennis ball deformation, and wherein the tennis ball has a second tennis ball deformation recorded after the tennis ball is exposed to atmospheric pressure for four months and unused, and wherein the second tennis ball deformation is no greater than 0.020 inches from the first tennis ball deformation.

* * * * *